US010006113B2

(12) United States Patent
DeMichael et al.

(10) Patent No.: US 10,006,113 B2
(45) Date of Patent: Jun. 26, 2018

(54) GAMMA TITANIUM DUAL PROPERTY HEAT TREAT SYSTEM AND METHOD

(75) Inventors: Thomas DeMichael, Stafford Springs, CT (US); Gopal Das, Simsbury, CT (US); Michael A. Moulin, Willington, CT (US)

(73) Assignee: United Technologies Corporation, Farmington, CT (US)

( * ) Notice: Subject to any disclaimer, the term of this patent is extended or adjusted under 35 U.S.C. 154(b) by 1277 days.

(21) Appl. No.: 13/590,446

(22) Filed: Aug. 21, 2012

(65) Prior Publication Data

US 2014/0053958 A1 Feb. 27, 2014

(51) Int. Cl.

| | |
|---|---|
| ***C22F 1/18*** | (2006.01) |
| ***C21D 11/00*** | (2006.01) |
| ***C22C 14/00*** | (2006.01) |
| ***C22C 21/00*** | (2006.01) |
| *C21D 1/62* | (2006.01) |

(52) U.S. Cl.

CPC ..... *C22F 1/183* (2013.01); *C22C 14/00* (2013.01); *C22C 21/00* (2013.01); *C21D 1/62* (2013.01); *C21D 2221/00* (2013.01); *C22F 1/18* (2013.01)

(58) Field of Classification Search

CPC .. C22F 1/002; C22F 1/18; C22F 1/183; C22C 14/00; C21D 1/62; C21D 1/63; C21D 1/64; C21D 1/667; C21D 1/673; C21D 11/00; C21D 11/005; C21D 2221/00; C21D 2221/01; C21D 2221/02; C21D 2221/10

See application file for complete search history.

(56) References Cited

U.S. PATENT DOCUMENTS

| | | | | |
|---|---|---|---|---|
| 3,753,793 | A * | 8/1973 | Wagener | B22D 11/1246 134/15 |
| 5,312,497 | A * | 5/1994 | Mathey | C22F 1/10 148/410 |
| 5,746,846 | A | 5/1998 | Kim et al. | |
| 6,425,964 | B1 | 7/2002 | Deevi et al. | |
| 7,255,829 | B1 * | 8/2007 | Peter | C21D 1/62 266/250 |
| 7,896,986 | B2 * | 3/2011 | Kottilingam | C22F 1/10 148/562 |
| 7,985,307 | B2 * | 7/2011 | Ozbaysal | C21D 1/09 148/421 |
| 2004/0003877 | A1 | 1/2004 | Hu | |
| 2010/0252151 | A1 | 10/2010 | Furrer et al. | |
| 2012/0148412 | A1 | 6/2012 | Decker | |

* cited by examiner

*Primary Examiner* — Scott Kastler
*Assistant Examiner* — Vanessa T Luk
(74) *Attorney, Agent, or Firm* — Backman & LaPointe, P.C.

(57) ABSTRACT

A method for forming a part having a dual property microstructure includes the steps of: forming a blank having a narrow top portion and a wide base portion; heating the blank to an elevated temperature; and forming a dual property microstructure in the blank by cooling different portions of the blank at different cooling rates.

5 Claims, 5 Drawing Sheets

GAMMA TITANIUM DUAL PROPERTY HEAT TREAT SYSTEM AND METHOD

BACKGROUND

The present disclosure relates to a system and a method for forming a part having a dual property microstructure.

Dual material properties can be achieved on the same piece of material by performing multiple heat treat cycles on a piece of material. This can be accomplished either in ovens with parts being cooled or insulated in certain areas, or by using induction heating to heat different areas of the part at different temperatures at the same time to achieve dual property microstructure. Costs to process, equipment expense, and thermal repeatability are all concerns. Having induction generators and the operators to process the material often limits the locations that these processes can take place. This can result in higher cost to process.

SUMMARY

In accordance with the present disclosure, there is provided a method for forming a part having a dual property microstructure, which method broadly comprises the steps of: forming a blank having a narrow top portion and a wide base portion; heating the blank to an elevated temperature; and forming a dual property microstructure in the blank by cooling different portions of the blank at different cooling rates.

In another and alternative embodiment, the method further comprises forming the cooled blank into the part.

In another and alternative embodiment, the blank forming step comprises forming a blank having a triangular shape with the narrow top portion and the wide base portion.

In another and alternative embodiment, the blank forming step further comprises forming a bottom which is flat so that the blank can be stood up.

In another and alternative embodiment, the heating step comprises heating the blank in a furnace.

In another and alternative embodiment, the cooling step comprises placing the blank on a grate, providing a plurality of cooling fans for flowing cooling air over said blank, and placing each of said cooling fans a distance from 1.0 to 3.0 feet from each side of said grate.

In another and alternative embodiment, the cooling step further comprises aiming a first one of the cooling fans at a first portion of the blank and aiming a second one of the cooling fans at a second portion of the blank.

In another and alternative embodiment, the cooling step further comprises cooling the first portion at a cooling rate in the range of 5.0 to 6.0 deg. F./sec. and cooling the second portion at a cooling rate in the range of 3.5 to 4.0 deg. F./sec.

In another and alternative embodiment, the cooling step further comprises aiming a plurality of the cooling fans at a first portion of the blank and blowing air over the first portion so that the first portion cools at a first cooling rate and allowing a second portion of the blank to cool at a second cooling rate different from the first cooling rate.

In another and alternative embodiment, the method further comprises forming the blade blank from a titanium based alloy.

Further, in accordance with the present disclosure, there is provided a system for forming a part having a dual property microstructure, which system broadly comprises: a blank formed from a metal alloy; means for heating the blank to an elevated temperature; and means for forming a dual property microstructure in the blank by cooling different portions of the blank at different cooling rates.

In another and alternative embodiment, the blank has a triangular shape with a narrow top portion, a wide base portion and a flat bottom.

In another and alternative embodiment, the blank is formed from a titanium alloy.

In another and alternative embodiment, the means for forming the dual property microstructure comprises a grate upon which the blank is placed in a heated condition and a plurality of cooling fans for cooling the blank.

In another and alternative embodiment, a first of the cooling fans is aimed at a first portion of the blank and a second of the cooling fans is aimed at a second portion of the blank.

In another and alternative embodiment, the cooling fans are aimed at a first portion of the blank so that the first portion cools at a cooling rate different from the cooling rate of a second portion of the blank.

In another and alternative embodiment, the cooling fans are spaced a distance in the range of from 1.0 to 3.0 feet from each side of the blank.

Other details of the gamma titanium dual property heat treat system and method are set forth in the following detailed description and the accompanying drawings wherein like reference numerals depict like elements.

DETAILED DESCRIPTION

Figure 1:
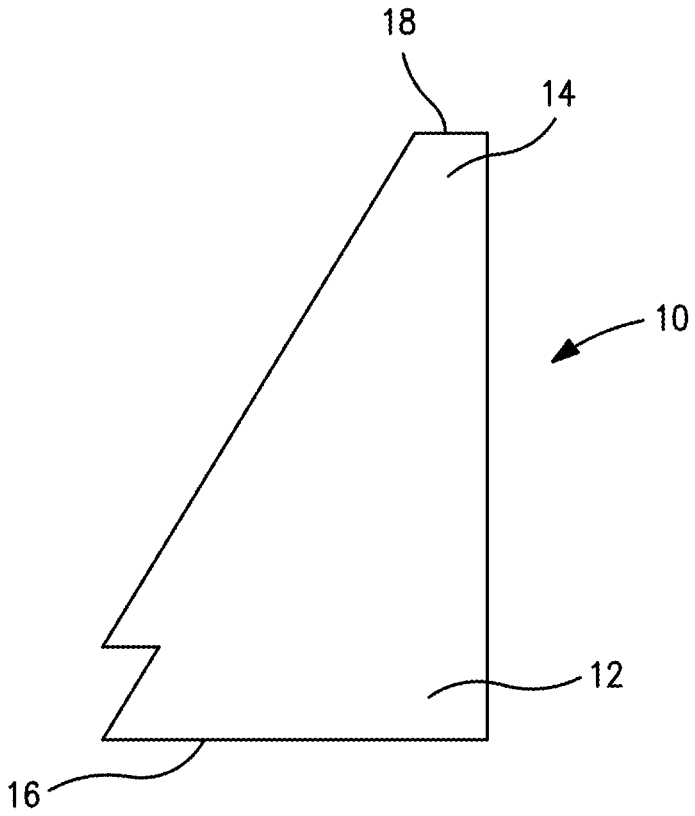
FIG. 1 is a schematic representation of a blade blank preform.

It has been found that by combining part geometry with cooling, one is able to achieve dual property microstructure on gamma titanium blade blanks. Referring now to FIG. 1, a blade blank 10 is shown. The blade blank may be formed from a titanium alloy such as Gamma TiAl. One suitable alloy is TNM alloy (Ti—43.5Al—4.0Nb—1.0Mo—0.1B, all in at %). The blade blank 10 may be cut for solution heat treatment in a preform geometry that is wide at the base 12 where a root attachment may be located, and thin at the top 14, where an airfoil tip may be located. The blade blank 10 has a triangular shape that is cut flat on the bottom 16. This allows the blade blank 10 to be stood upright with the base 12 on the bottom and the tip 18 facing upward.

Figure 2:
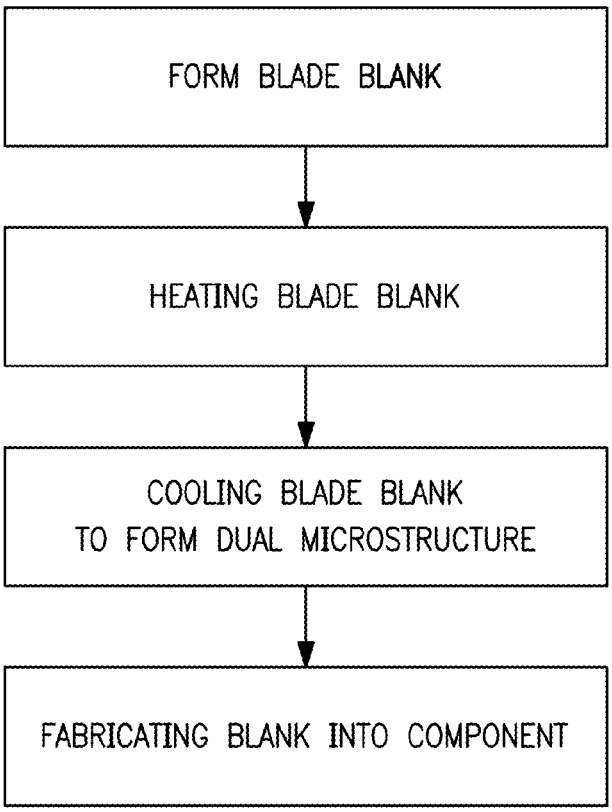
FIG. 2 is a schematic representation of a method for forming an article having a dual property microstructure.

As can be seen from FIG. 2, after being formed, the blade blank 10 is subjected to a heat treatment. One exemplary heat treatment uses a temperature in the range of from 2240 deg F. to 2320 deg F. for a time period of one hour. The heat treatment may be performed in any suitable furnace such as an air furnace. Typically, the blade blank 10, when formed from a titanium alloy, will be removed from the furnace at a temperature of approximately 2300 degrees F.

Figure 3:
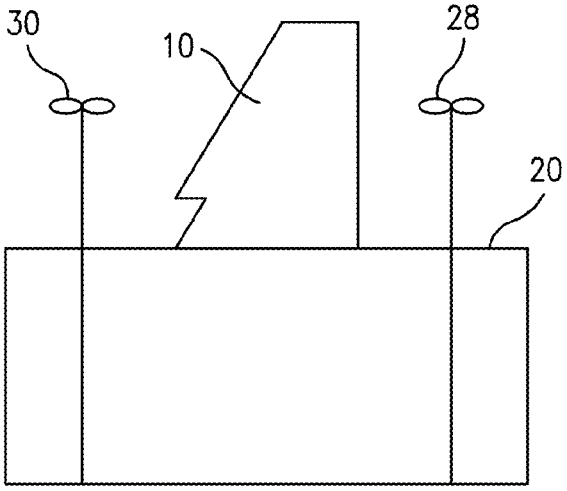
FIG. 3 is a schematic representation of a cooling system used in the method of FIG. 2.
Figure 4:
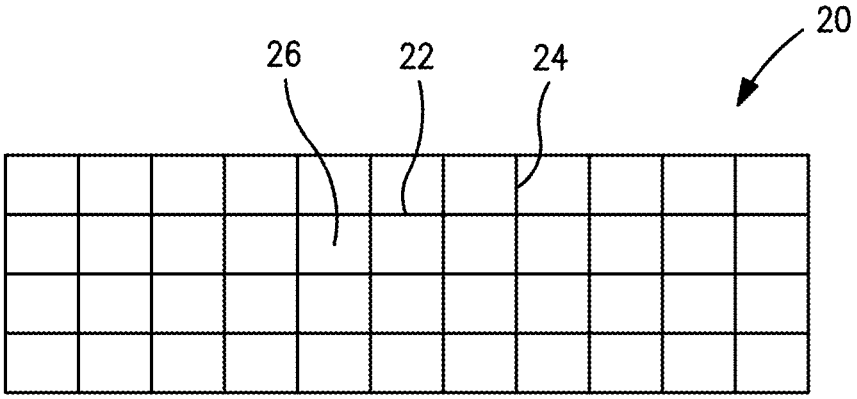
FIG. 4 illustrates a grate used in the cooling system of FIG. 3.

The blade blank 10 thus formed is then placed onto a grate 20 as shown in FIG. 3. The grate 20 may have a grid construction with formed by a plurality of intersecting bars 22 and 24 as shown in FIG. 4. The grate 24 may be formed from any suitable metallic material such as a nickel alloy sold under the name HAYNES 230. The grid construction may be such that there are a plurality of openings 26 in the grate.

Positioned in close proximity to the grate 20 are a plurality of cooling fans 28 and 30. The cooling fans 28 and 30 may be positioned and angled so as to blow cooling air on different portions of the blade blank 10 in order to cause the different portions to cool at different rates and thus create different microstructures. For example, the cooling fan 28 could be aimed to blow cooling air at the top part 14 of the blank and the cooling fan 30 may be aimed to blow cooling air at the base 12 of the blade blank. By doing this, the thinner top area 14 cools at a much greater rate than the wide base 12. This yields a dual property microstructure based on cooling rates. The dual property microstructure may be a fully lamellar microstructure at the fast cooled area and a duplex microstructure (consisting of a globular gamma phase in a lamellar matrix) at the slower cooling rate area. This will happen when the material is heat treated at a temperature above the alpha transus temperature (alternate plates of alpha 2 and gamma). For TNM gamma alloy, the alpha transus temperature is 2320 degrees Fahrenheit.

Alternatively, one can achieve a duplex microstructure with different volume fraction of gamma phase if the heat treatment is done below the alpha transus temperature. Cooling at different rates follows if heat treatment will lead to the formation of a duplex microstructure. The end with the smaller area will experience a faster cooling rate which will develop lower volume fraction of globular gamma phase, while the end with the larger mass (slower cooling rate) will yield a higher gamma volume fraction.

The cooling fans 28 and 30 may be placed from 1.0 to 3.0 feet, such as 2.0 feet, from each side of the grate 24.

Alternatively, the cooling fans 28 and 30 may be angled or tipped in to favor the top area 14 of the blade blank 10, if desired, so that cooling air flows over the top area 14 and cool the top area 14 at a first cooling rate different from the cooling rate at which the base 16 cools.

If desired, a first portion of the blade blank 10 may be cooled at a rate of 5.0 to 6.0 deg. F./sec., while a second portion of the blade blank 10 is cooled at a rate of 3.5 to 4.0 deg. F./sec.

Figure 5:
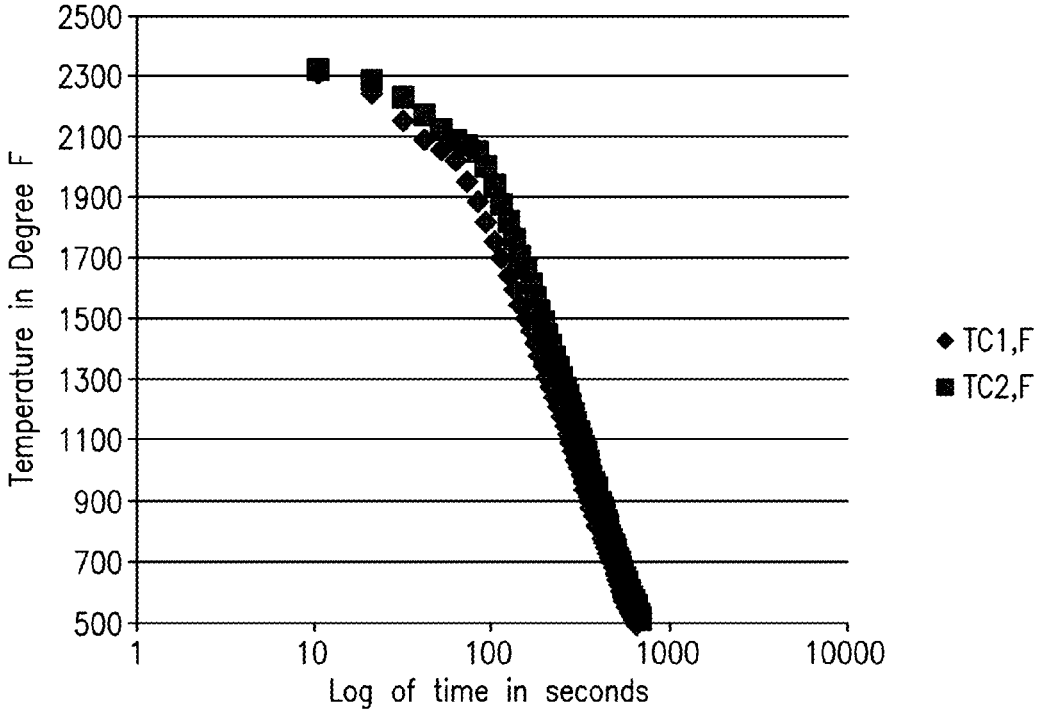
FIGS. 5 and 6 are graphs showing cooling rate curves for thin and thick sections of a blade blank preform.
Figure 6:
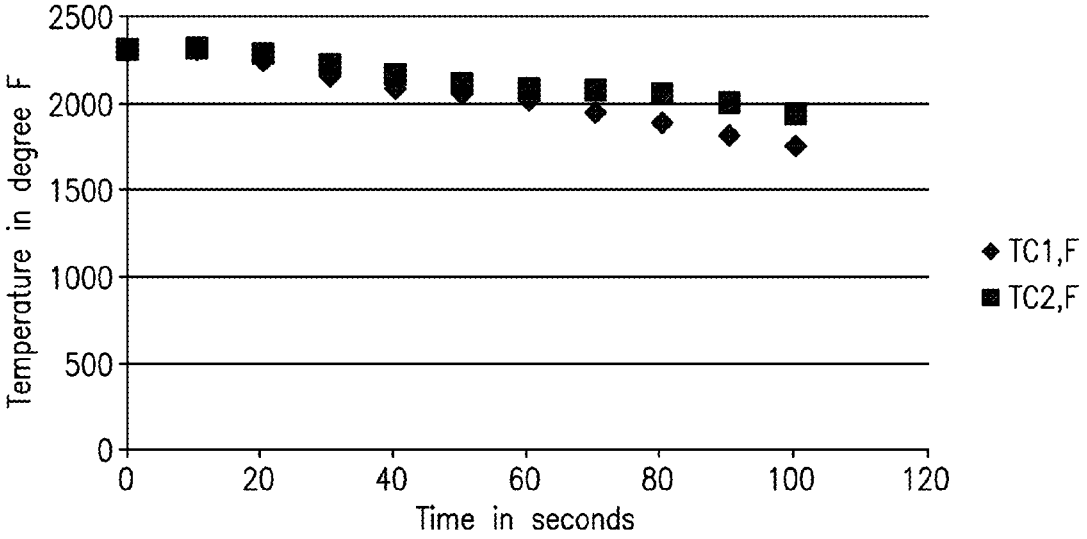

FIGS. 5 and 6 illustrate cooling rate curves for thin and thick sections as determined from thermocouple data. TC1 represents a thermocouple inserted in a thin section, such as portion 14 of the blade blank 10, and TC2 represents a thermocouple inserted in a thick section, such as section 12 of the blade blank 10.

Figure 7:
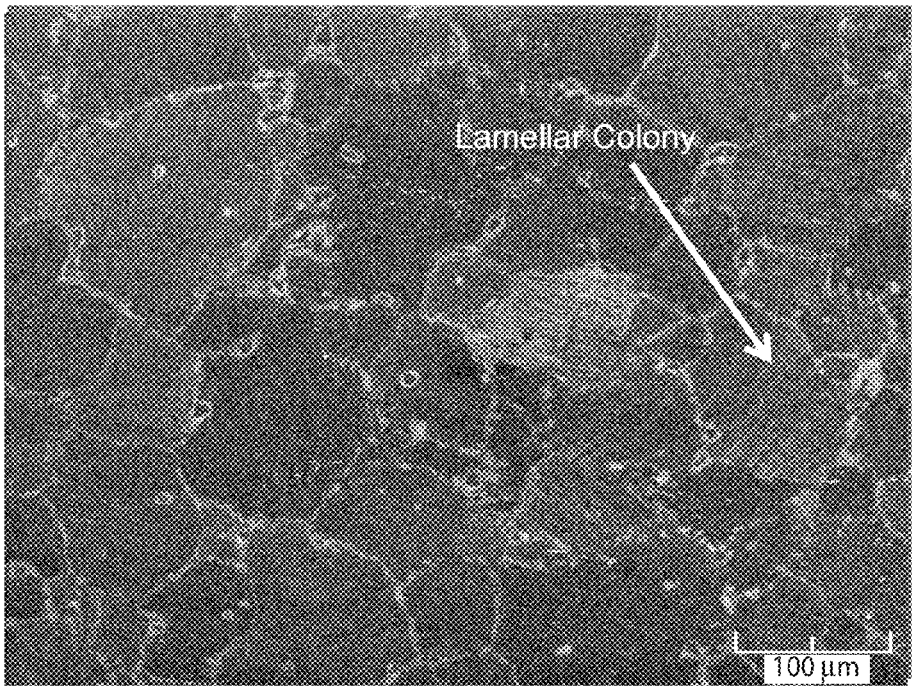
FIG. 7 is an SEM photomicrograph of a fast cooled section showing a fully lamellar microstructure.
Figure 8:
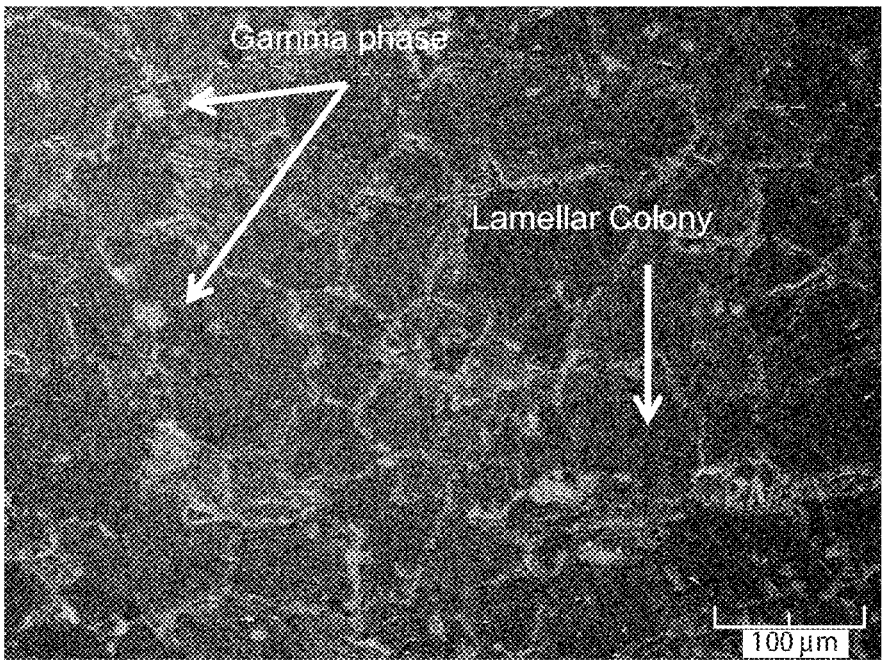
FIG. 8 is an SEM photomicrograph of a slow cooled section showing a duplex microstructure consisting of fine gamma phase in a lamellar matrix.

FIG. 7 is an SEM photomicrograph of a fast cooled section showing a fully lamellar microstructure. FIG. 8 is an SEM photomicrograph of a slow cooled section showing a duplex microstructure consisting of fine gamma phase in a lamellar matrix.

After cooling, the blade blank 10 can be formed into any suitable article using any suitable technique known in the art. For example, the blade blank 10 could be machined into a turbine engine component such as a low pressure turbine blade.

The process of the present disclosure allows a dual property microstructure to be obtained without the cost of induction heating equipment, trial and error of fabricating induction coils to provided desired results. In addition to cost savings, other benefits include the ability to process material in locations that do not have this equipment, and repeatability. It is very easy to achieve repeatability, only needing to ensure starting temperature, and distance from cooling fans.

In accordance with the present disclosure, there has been provided a gamma titanium dual property heat treat system and method. While the system and method have been described in the context of specific embodiments thereof, other unforeseeable modifications, variations, and alternatives may become apparent to those skilled in the art having read the foregoing description. Accordingly, it is intended to embrace those alternative, modifications, and variations as fall within the broad scope of the appended claims.

What is claimed is:

1. A method for forming a part having a dual property microstructure, said method comprising the steps of:

forming a blade blank having a triangular shape having a narrow top portion and a wide base portion;

heating said blade blank to an elevated temperature;

forming a dual property microstructure in said blade blank by cooling different portions of said blade blank at different cooling rates;

placing said blade blank on a grate, providing a plurality of cooling fans for flowing cooling air over said blade blank, and placing each of said cooling fans a distance from 1.0 to 3.0 feet from each side of said grate;

aiming a first one of said cooling fans at said narrow top portion of said blade blank and aiming a second one of said cooling fans at said wide base portion of said blade blank;

cooling said narrow top portion at a cooling rate in the range of 5.0 to 6.0 deg. F./sec. and cooling said wide base portion at a cooling rate in the range of 3.5 to 4.0 deg. F./sec, wherein said narrow top portion comprises a fully lamellar microstructure and said wide base comprises a duplex microstructure consisting of a globular gamma phase in a lamellar matrix.

2. The method of claim 1, further comprising forming said cooled blade blank into said part.

3. The method of claim 1, wherein said blade blank forming step further comprises forming a bottom which is flat so that blade blank can be stood up.

4. The method of claim 1, wherein said heating step comprises heating said blade blank in a furnace at a temperature above an alpha transus temperature.

5. The method of claim 1, further comprising forming said blade blank from a titanium based alloy.

* * * * *